United States Patent [19]

Clapp

[11] Patent Number: 4,856,244

[45] Date of Patent: Aug. 15, 1989

[54] TILT-WALL CONCRETE PANEL AND METHOD OF FABRICATING BUILDINGS THEREWITH

[76] Inventor: Guy C. Clapp, 5412 Hidden Oaks La., Arlington, Tex. 76017

[21] Appl. No.: 56,389

[22] Filed: Jun. 1, 1987

[51] Int. Cl.[4] ..... E04B 1/00

[52] U.S. Cl. ..... 52/309.7; 52/309.12; 52/220; 52/351

[58] Field of Search ..... 52/405, 443, 745, 351, 52/353, 309.12, 220, 309.7, 743

[56] References Cited

U.S. PATENT DOCUMENTS

| | | | |
|---|---|---|---|
| 2,539,904 | 1/1951 | Hansen | 52/405 |
| 3,435,581 | 4/1969 | Ahlqvist | 52/405 |
| 3,621,624 | 11/1971 | Gustafson | 52/220 |
| 3,707,165 | 12/1972 | Stahl | 52/220 |
| 4,284,447 | 8/1981 | Dickens et al. | 52/309.7 |
| 4,314,430 | 2/1982 | Farrington | 52/309.12 |
| 4,512,126 | 4/1985 | Walston | 52/405 |
| 4,542,613 | 9/1985 | Leyte-Vidal | 52/309.12 |
| 4,573,302 | 3/1986 | Caretto | 52/745 |
| 4,674,242 | 6/1987 | Oboler et al. | 52/309.12 |

*Primary Examiner*—David A. Scherbel
*Assistant Examiner*—Caroline D. Dennison
*Attorney, Agent, or Firm*—Charles W. McHugh

[57] ABSTRACT

Tilt-wall concrete panels adapted for constructing small buildings with "finished" interiors, especially single-family residences, etc. A peripheral frame of wooden members is laid on top of a barrier film of plastic (e.g., 4 mil polyethylene) on a horizontal surface. Wood-like studs are then placed within the frame and nailed thereto. Any desired utility cables and service pipes are positioned within the frame. An insulating foam cover, preferably high-density polyurethane, is then generated within and over the frame, to a depth that at least covers the wood-like studs and any utility or service lines. Foam about 1.5 inches thick will cover these elements and bond them securely together as a stable, easily movable "plate"—after the foam plastic has hardened. A plurality of such plates, each sized to form a part of a building's wall, are positioned at a construction site where a foundation has been prepared; a concrete form is then temporarily completed around each plate, and concrete is poured on top thereof, to an average depth of about 4 to 6 inches. After the concrete hardens, the temporary form is removed and the composite panel is tilted to a vertical position. A plurality of such panels are positioned edge-to-edge and joined to form a continuous outer wall for the building. The plastic barrier film is removed from the face of each panel, and interior wallboards or the like may be nailed to the exposed wood-like studs.

14 Claims, 3 Drawing Sheets

TILT-WALL CONCRETE PANEL AND METHOD OF FABRICATING BUILDINGS THEREWITH

BACKGROUND OF THE INVENTION

This invention relates generally to a method for constructing a house or similar building using tilt-wall concrete panels, more particularly, it relates to a method of creating a high-strength, thin, thermally efficient concrete/foam panel by use of a reduced number of auxiliary devices, frames or molding elements.

It is well known to construct buildings for use as offices, warehouses, factories, stores and the like by the use of tilt-wall concrete construction techniques which are exemplified in the teachings of patents such as US Pat. No. 4,104,356 to Deutsch and Jones entitled "Tilt-Up Panel Bracket" and U.S. Pat. No. 3,555,763 to Bloxom entitled "Method of Forming Walls with Prefabricated Panels." However, the concrete walls created by these conventional building techniques have their greatest utility in what may best be described as commercial buildings, for the reason that the interior surfaces of such concrete walls are not considered suitable for sophisticated buyers of residential properties. That is, builders of residential properties recognize that conventional wood studs need to be added to the insides of concrete walls in order to provide space for insulation and utility conduits, as well as to provide an anchor into which nails may be driven when installing conventional interior paneling materials such as gypsum board (or sheet rock) or wood paneling. The expense and time of installing wood or metal studs to an existing concrete wall has meant that traditional tilt-wall construction techniques have generally not been considered economically feasible for residential construction.

In an attempt to obviate the economic disadvantage of attaching studs to a standing concrete wall, US Pat. No. 4,059,939 to Eilliott entitled "Prefabricated Building Unit" teaches the concept of casting concrete on top of a completed wooden frame of traditional size and strength, and ensuring a mechanical connection between the wooden panel and the hardened concrete by virtue of providing numerous long nails that protrude upwardly from the wooden studs into the cavity that is to be filled with wet concrete. Additionally, Elliott teaches the inclusion of prefabricated insulation boards between the concrete and the wooden studs, such that a three-quarter inch insulation board (for example) is captured between the hardened concrete and the interior wooden frame. While the teachings of Elliott might seem to go a long way toward meeting some of the objections of tradition tilt-wall techniques as they are applied to commercial buildings, there are still certain difficulties in adapting tilt-wall concepts to residential construction. For example, Elliott teaches that his concrete and wooden panels are best fabricated in a factory and then lifted by a crane onto a truck for transportation to a construction site. A crane would then be employed to remove a panel from the truck and lower it onto a prepared foundation. Such a process has several disadvantages, including the fact that a crane must be employed to first load the panel on a truck at the site where the panel is fabricated, and a crane is also required at the construction site where the house is to be built. This either requires the use of two cranes or the movement of one crane (a large and sometimes awkward piece of mechanical equipment) from a factory and along public streets to a residential building area. Furthermore, the Elliott process appears to offer no savings in materials as compared with previously known techniques for attaching wooden frames to the interior of a tilt-wall building. There has therefore remained a need for an economical and efficient technique for constructing houses and similar buildings in which the advantages of tilt-wall construction can be exploited in the fabrication of residential buildings asnd the like. It is an object of this invention to provide such a technique.

Another object is to provide a construction technique for standardizing the installation of utility conduits and the like by positioning them in a highly controlled environment such as a factory, rather than leaving their installation to the discretion or judgment of workers at a remote construction site.

Still another object is to provide an improved building panel for residential construction techniques in which a relatively thin wall panel thickness is achieved without any degradation of thermal efficiency.

A further object is to provide a relatively strong but economical and attractive building, using materials that are likely to be readily available in most developed areas.

These and other objects will be apparent from a reading of the specification and the claims appended thereto, with reference to the accompanying drawings forming a part hereof.

BRIEF DESCRIPTION OF THE INVENTION

Figure 1:
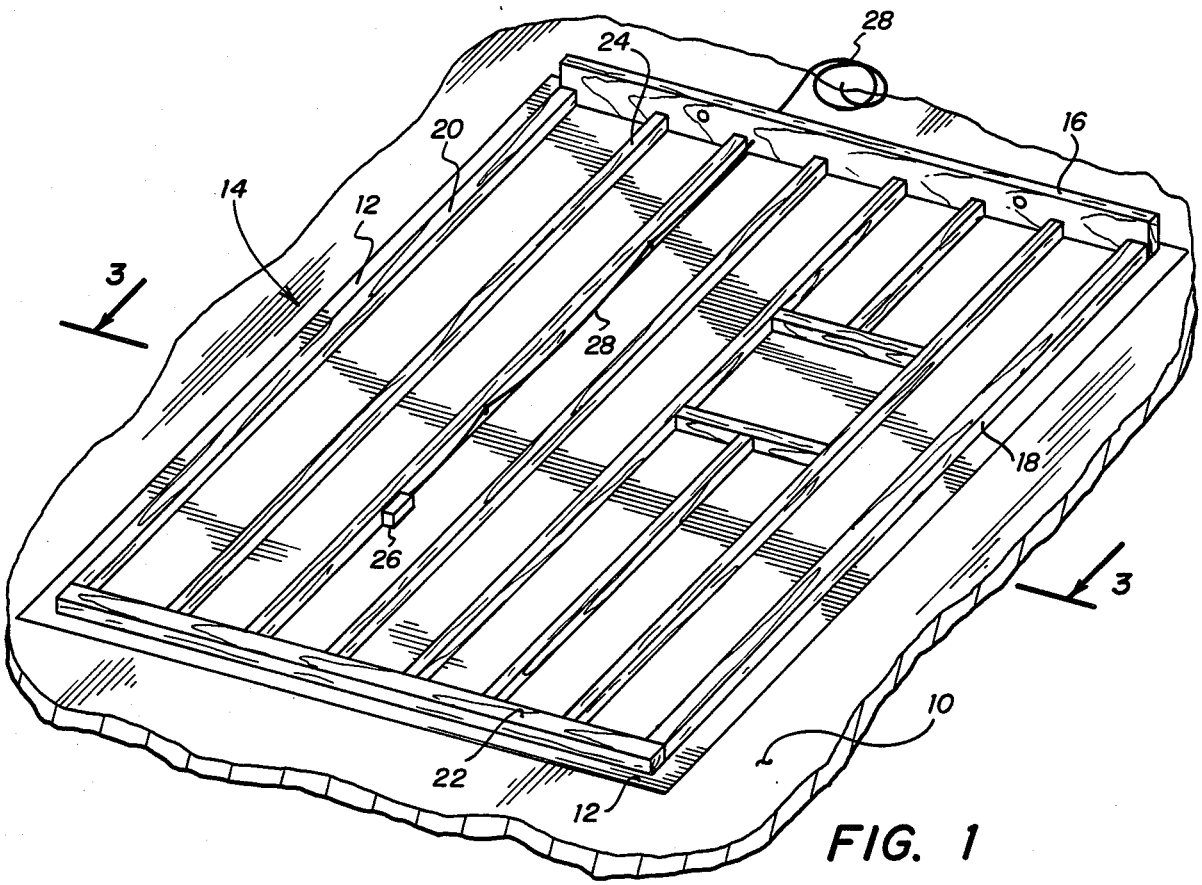
FIG. 1 is a perspective view of a frame positioned horizontally on top of a work surface, showing certain components of the panel prior to the time that an insulating plastic foam is generated.

In brief, the invention encompasses a method of fabricating a tiltwall concrete/foam panel; one embodiment is particularly adapted for constructing a building such as a single-family residence. Each panel has an exterior of cementitious material and a smooth interior with readily accessible studs of wood or the like. Initially, a generally horizontal and flat work surface is established in a factory or some other convenient working area. The size of the work surface must be somewhat larger than the size of the largest panel that is to be fabricated, so that a peripheral frame of wooden members (e.g., 2×4 inch boards) may be laid on top of the work surface. The work surface is covered with a barrier film of non-adherent plastic such as 4 mil polyethylene, and the peripheral frame is laid on top of the film. A plurality of wood-like studs are then positioned within the frame and secured thereto in such a way that they lie on top of the polyethylene film (which will define the interior face of the concrete/ foam panel when it is completed). Next, any desired utility cables, boxes, conduits, wires and the like are placed within the boundary defined by the frame and secured typically with light-duty fasteners, so that they are fixed in position and will not be accidentally moved during a subsequent step. An insulating foam cover is then generated in situ within the frame to a depth so as to at least cover the wood-like studs--and usually any utility cables, etc. High density polyurethane foam (in the range of 1½ to 4 pounds per cubic foot) is the preferred material for this part of the panel. A foam thickness of about 1½ inches will usually be adequate for a concrete/foam panel which is intended to serve as the exterior wall for a typical single-family residence; but the foam will generally be only about ½inch thich over the wood-like studs, in order to leave adequate room for the concrete is to be cast on top of the foam. After the foam has cured, the frame is ready to be transported to a site where the building is to be erected and where a foundation has already been prepared or is being prepared.

The frame and foam "plate" (or planar segment) is positioned "face down" on top of the smooth foundation, and a concrete form is created by placing boards (typically 2×6 inch boards) around said "plate". Wet concrete is then poured into the 2×6 frame, usually to the full depth thereof-- which is actually about 5 ½ inches. After the concrete has set, the resulting structure--which may now be properly described as a concrete/foam composite panel-- is tilted upright at an appropriate location on the foundation, typically at one edge thereof. Any unwanted members of the concrete frame are removed from the composite panel, and the polyethylene film is pulled away from its face. When the panel is being used in a single-story building, the top of the concrete form will usually be left with the composite panel to form a permanent part thereof; the roof structure is then nailed to the top piece. For some multistory buildings, the top as well as the sides and the bottom of the form may be removed after the concrete has cured. Other composite panels, each with its own quantity and arrangement of windows, doors, utility outlets, etc., are similarly built. Adjacent concrete and foam plastic panels are connected to one another at their respective edges (sides), and the bases of the panels are anchored to the foundation--with bolts or other fasteners, or with welding. Gypsum board (or sheet rock) or other interior paneling is then readily nailed to the wood-like studs, and the protruding ends of the electrical cables at the tops of the composite panels are then connected to appropriate fixtures, switches, and utility outlets in the same way that electrical wiring is routinely connected in a custom-built building, etc. Any gaps between adjacent panels are caulked or otherwise filled with a resilient material, and the exterior concrete surface is finished in a customery manner.

DETAILED DESCRIPTION OF ONE EMBODIMENT OF THE INVENTION FOR BUILDING SINGLE-FAMILY RESIDENCES AND THE THE LIKE

Figure 2:
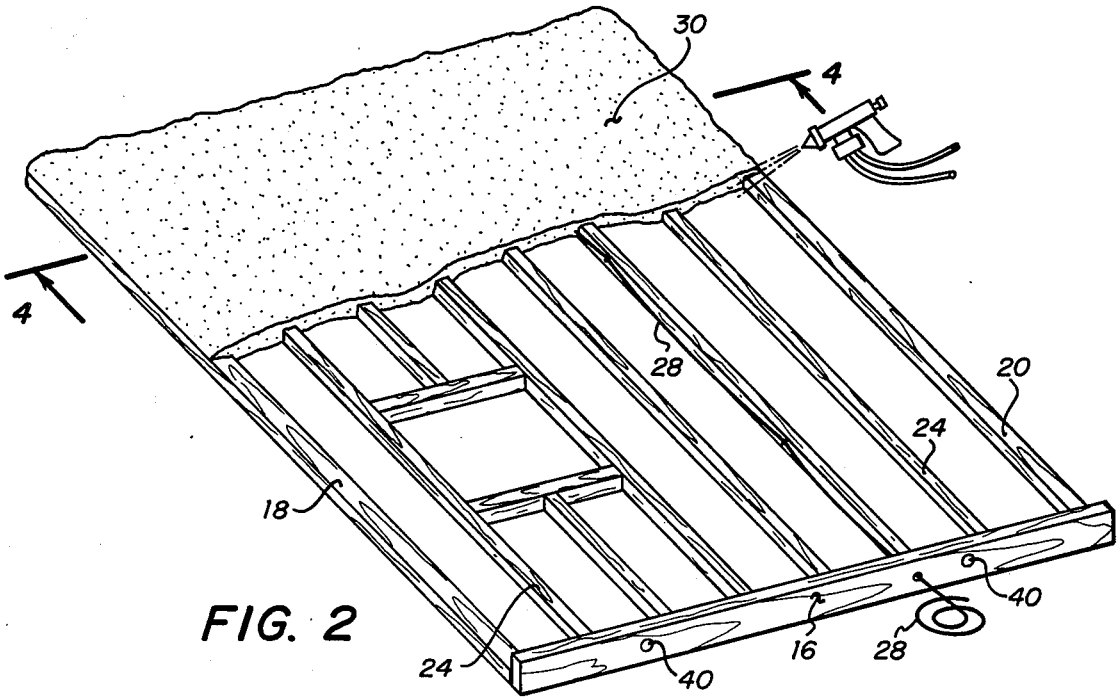
FIG. 2 is a perspective view of the same panel that is shown in FIG. 1, which now has been rotated approximately 90 degrees clockwise, with a fragmentary portion of the plastic foam being shown where it has been generated on top of the frame and its stud-like members.
Figure 3:
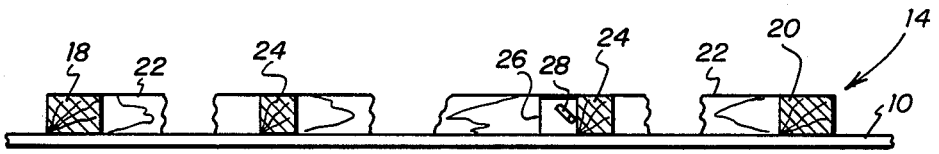
FIG. 3 is a fragmentary cross-sectional view taken in the plane represented by lines 3—3 in FIG. 1.

Turning first to FIGS. 1 and 2, a generally horizontal work surface 10 is established at a convenient location which is preferably dry, clean and well illuminated. Such a surface 10 is preferably prepared in a factory, workshop or other secure location where careful and measured work may be safely performed with automatic and semi-automatic tools and equipment, including air-powered nailers, staplers, etc. One reason for selecting a factory-type work area for this early step in the process of fabricating a panel is to avoid the interruptions which can be caused by inclement weather (including rain, snow, high winds, etc.) as well as avoiding the risk of loss or theft of building materials at a remote construction site. Additionally, completing the early phases of panel construction in a factory environment makes it possible to more nearly ensure quality control in implementing the design decisions that have been made with regard to the number and location of utility outlets and service conduits, etc. In other words, it is easier to supervise the construction of a variety of panels when they are at least partially pre-fabricated in a concentrated work area instead of being individually created at varied and remote locations. Also, construction materials may be kept cleaner and protected from accidental damage when they are stored in a covered environment until such time as an individual panel is to be built.

A typical flat and smooth work surface 10 is advantageously a large frame of steel that is covered with plywood, approximately 25 feet long and 9 feet wide. A work surface this size will usually provide sufficient space and clearance for pre-fabricating a planar segment of almost the same size, which should be adequate to take care of essentially all requirements for building panels for single-family residences and similar small buildings. A plywood work surface 10 does not constitute a heat sink for the warm foaming plastic, and it can also provide a base to which clamps may be easily attached for temporarily holding framing boards in place.

On top of the work surface 10 is temporarily placed a non-adherent film 12, which may advantageously be a sheet of polyethylene plastic approximately 4 mils thick. The purpose of the film is to serve as a barrier between the work surface 10 and the plastic foam which will be generated in situ and which will constitute most of the interior face of the finished plate. The integrity of the film 12 is important but not critical, because it can be patched with simple patching techniques (including something as simple as duct tape) if a small tear is discovered. This is advantageous because of its simplicity and, indeed, the entire process disclosed herein is characterized by simplicty, economy and reliability. Expressed in other words, there are no parts of this construction method which employ unusually precise tolerances or exotic materials that might dictate the use of highly skilled and/or expensive labor. In fact, if polyethylene film or its equivalent is not available, the work surface 10 may even be coated with an ordinary releasing agent, so that the foamed plastic that is generated on top of the work surface will not adhere thereto.

The next step in the process involves creating a peripheral frame 14 for the panel--on top of the work surface. Typically the peripheral frame 14 is formed by nailing together four members: a top 16, a right side 18, a left side 20 and a bottom 22. Ideal frame members are boards having a nominal size of 2×3 inches, 2×4 inches and 2×6 inches, or similarly sized aluminum channels, which are widely available and have the requisite strength to function as an open frame for building a large panel. The frame 14 is laid out on the work surface 10 and all angles are carefully checked to make sure that they are 90 degrees, etc; temporary clamps are advantageously affixed to the work surface to ensure that the frame remains true during this phase of the fabrication process.

Next, a plurality of wood-like studs 24 are positioned interiorly of the open frame 14 and arranged, side to side, using distances that will usually be larger than the spacing for conventional wall studs in what some persons refer to as "stick and brick" residences. Thus, the wood-like studs 24 will usually be about 24 inches apart, but they need not be of the same material or size as conventional wood studs (which are typically 2×4 inch white pine or fir). This is because the rib-like members 24 in accordance with this construction do not need to have an inherent strength and rigidity in order to remain vertical and transfer loads in the way that conventional wall studs do. Instead, the members 24 in this construction serve primarily as anchoring spots for the nails, screws, staples or other fasteners that will be subsequently utilized to affix an interior covering to the inner face of a completed panel. Additionally, the materials from which stud members 24 are fabricated will likely be wood; but other materials-such as metal or closed-cell foamed plastics--are known to be appropraite substitutes for wood when either price or environmental conditions might make a substitute desirable. So, in an area where wood is scarce or expensive, or is subject to rapid attack by termites, etc., a wood-like material (including its equivalent in metal) could be readily substituted for the normally preferred wooden studs 24. These studs 24 are usually anchored at their ends to the open frame 14 by driving one or more nails transversely through the top 16 and the bottom 22 of the frame.

Edge members 18, 20 are also nailed to the top and bottom pieces of the frame 14. These edge members 18, 20 are typically 2×4 inch boards, oriented with their long sides flat against the film 12, which means that they will subsequently provide a significant surface area into which a connector for two adjacent panels might be anchored.

The next step involves placing within the peripheral frame 14 may utility devices, wires, vent pipes and the like which will be desired in the eventual panel. For example, if an electrical outlet or a light switch is wanted in a given panel, provision for it must be made at this time. For an electrical service outlet, an electrical box 26 will be tacked to the side of one of the stud members 24 at the appropriate location and with its open face toward the film 12. Appropriate conduits or wires 28 (of a size and nature to satisfy any pertinent building codes) would then be placed inside the frame 14, so that one end of the conduit extends into the box 26; the other end of the conduit passes through a prepared aperture in the top member 16 and extends outside the frame. Any other electrical, telephone, television, water or gas service which is desired in an exterior wall would be accomplished by positioning the appropriate pipes, conduits, wires, etc., in accordance with plans that had been established by the builder.

Figure 4:
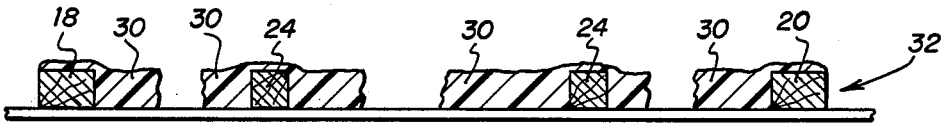
FIG. 4 is a fragmentary cross-sectional view taken in the the plane represented by lines 4—4 in FIG. 2.

After all utility connections and the like have been established within the frame 14, usually adjacent the film-side thereof, a foamed plastic 30 is next produced within the frame by placing therein a foaming plastic in liquid form; said liquid is caused to foam until it produces a foamed body having a depth which is at least adequate to cover the plurality of woodlike studs 24 and probably most of the peripheral members 18, 20, 22, as well as many of the utility elements (e.g., any Romex cables, etc.). If the foam body 30 is made of inherently closed-cell foaming material, then waiting a few seconds for the foam to set will produce a water-impervious top skin that will automatically complete this face-producing step. On the other hand, if the plastic foam is initially open-celled, it will be necessary to subsequently seal its top in order to produce a body that can function as the bottom of a mold for eventually receiving wet concrete. The preferred material for this insulating body 30 is a polyurethane foam having an integral skin and a minimum density of 1 pound per cubic foot; to further ensure the requisite holding strength, a density of 1½ pounds per cubic foot is preferred as the "low side" value. A density in excess of 4 pounds per cubic foot is probably not cost effective, for the reason that any extra strength is probably not worth the extra expense. Therefore, the preferred range of densities can be said to be between 1½ and 4 pounds per cubic foot. A suitable foaming material is sold by Carpenter Insulating and Coatings Company (having an office in Dallas, Texas) under their notation 275-B class II polyurethane resin. In general, it is expected that foam body 30 will be approximately 1½ inches thick in regions between any two adjacent studs 24, and about ½ inch thick in regions immediately over the studs, as represented in FIG. 4. In other words, it is believed desirable to have at least ½ inch of polyurethane insulating material between any interior studs and the exterior concrete.

In a very short time the preferred urethane foam will have cured so that it creates a rigid side-to-side and top-to-bottom structural component which secures the studs 24 in an immovable position in the frame 14; the foam also supports any utility devices in the exact location they were in before the foam was generated. If the selected foam is high-density polyurethane, the excellent adhesion between the foamed plastic and the frame members 16, 18, 20, 22 as well as the adhesion between the plastic and studs 24, will produce an exceedingly strong "plate" 32 for the bottom of a mold or form into which concrete may be subsequently poured at will. Indeed, the combined strength of the frame 14 and the integrally foamed plastic 30 is sufficient that the plate 32 can be readily transported for substantial distances to a building construction site without any concern that the plate will warp or become skewed during normal handling.

While the plate or planar segment 32 is very strong, it is not exceedingly heavy; and it is common to simply utilize a few strong laborers to manually lift the plate off the work surface 10 and place it on the bed of an adjacent truck or trailer. A typical plate 32 about 20 feet long and slightly more than 8 feet high, with the preferred 2×2 inch studs 24 and polyurethane foam at about three pounds per cubic foot, will weight about 150 pounds, which can be manually handled without too much trouble by three or four workers. The plate 32 is also relatively thin; and even if a 2×6 inch header board is attached to the top of the frame 14 in the factory, two such plates can be placed face to face (with the header boards sticking out over the edge of the truck bed) and take up very little vertical space.

Before the plate 32 is removed from the preferred (i.e., clean, dry, factory-type) fabrication site, it will probably be appropriate to take advantage of the powered equipment that is normally available in such a facility. For example, it is advantageous to drill at least one hole (and usually two) transversely through the top member 16, and then slightly elongate the hole to create a generally slot-like opening 40 almost 1 inch long. At the building construction site, a piece of steel cable (about $\sqrt[3]{}$ inch in diameter) is advantageously formed into a loop 42, and the two ends of the cable are passed through the slot 40 (from the outside to the inside). The two ends of the cable are then positioned so that they will be securely imbedded within the concrete that is poured on top of the plastic foam 30. When the concrete has cured, the externally protruding loop 42, either alone or in combination with another loop, can be connected through a cable to a crane, so that the composite panel can be easily tilted upward at one edge of the foundation.

Figure 5:
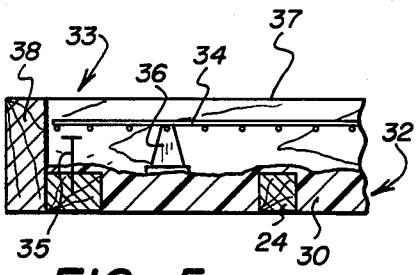
FIG. 5 is a fragmentary, cross-sectional view of a left-hand corner of a peripheral form, just prior to the time that concrete is poured into the form and on top of the plastic foam.
Figure 6:
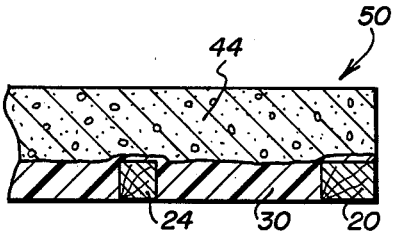
FIG. 6 is a fragmentary view of the top right-hand corner of a completed concrete/foam panel, with the top board (or header board) being removed to show the relative positions of the main constituents of a panel.
Figure 7:
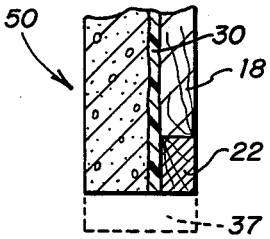
FIG. 7 is a fragmentary, cross-sectional view of the bottom of a completed panel, showing the relative position of the horizontal foot and a representative vertical stud-like member.
Figure 8:
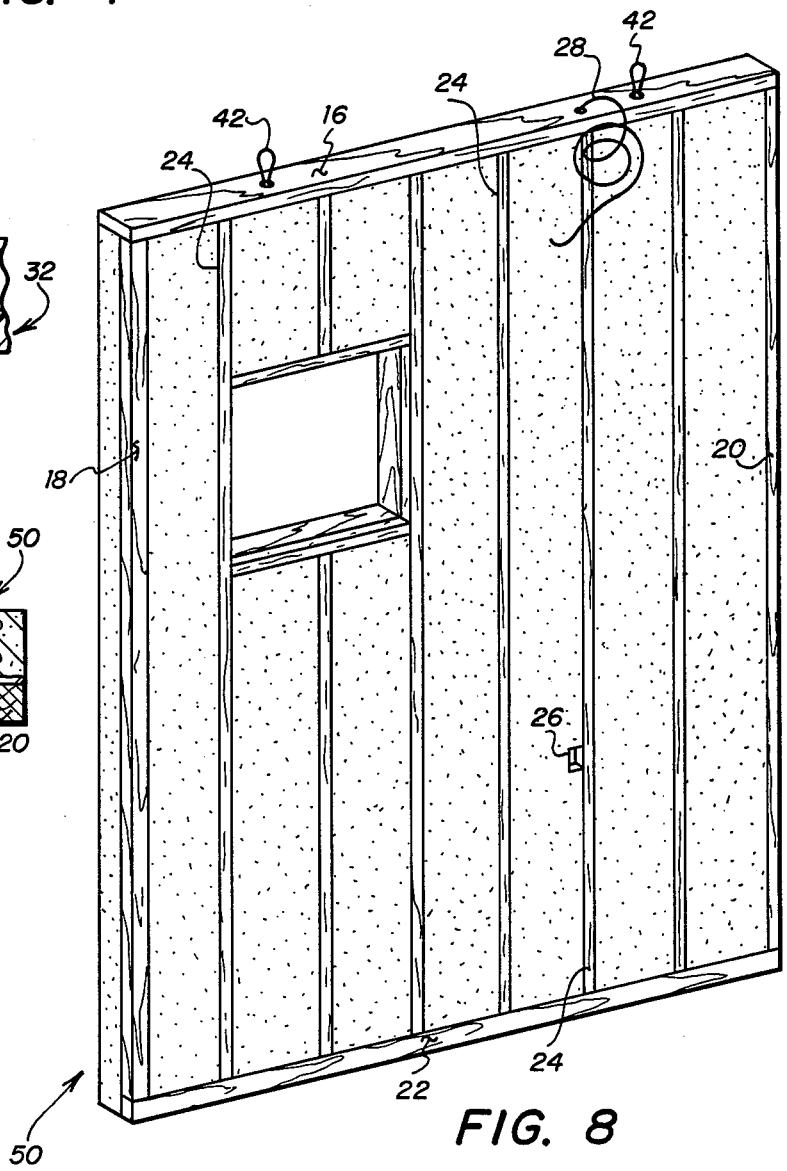
FIG. 8 is a perspective view of a completed concrete/foam panel after it has been tilted upward and is ready for installation as a part of a building.

After all of the plates 32 have been transported to the prepared foundation site for the building, they are laid "face down" on top of the foundation. A concrete form is then created by affixing a peripheral frame of wooden members, typically 2×6 inch boards, around the plate 32; aluminum forms are also useful for this function, and they are relatively easy to keep clean and are re-usable. Before wet concrete is poured into the form 33 (represented by the two wooden members 37, 38) shown in FIG. 5, it is advantageous to drive a few nails transversly through the top member 16 into the space immediately above foam member 30. Other nails 35 may be driven from the back side of the plast 32 into the frame members 18, 20 and the wood-like studs 24; at least part of their length is left protruding upwardly into open space. These protruding nails will then be firmly anchored in the concrete that subsequently fills the wide, shallow cavity that is defined by the peripheral form 33 and the plate 32. As with any substantial concrete structure, it will likely be advantageous to provide reinforcing rods or wire mesh (represented by members 34 in FIG. 5) in the space that is to be filled with concrete. Plastic chairs, indicated by the device 36, can be used at this time to hold the wire mesh 34 in an elevated position so that it will eventually be completely surrounded by concrete.

After concrete 44 has been poured into the form 33 and allowed to set--to produce a plurality of concrete/-foam composite panels 50, the sides and bottom of the form are removed by prying them away from the panel. Any window or door framing members that are not necessary for anchoring their respective windows or doors are also removed at this time. A crane or similar piece of lifting equipment is then utilized to tilt the panels 50 upward until they are vertical. Usually a first panel 50 will be permanently connectd to the foundation, and adjacent panels will then be serially connected, first to the foundation and then to each other, so as to completely enclose what is to become the interior of the building. Any existing gaps between adjacent panels 50 are filled with caulking and/or a resiliant joint material. A roof is then added to the building in a traditional manner, and the building is then ready to have its windows and doors installed so that it is completely "in the dry". (It is relatively easy to install roof trusses without causing interference with the cable loops 42, so they may be simply left in place on top of the panel 50.) At this time it is appropriate to provide a protective cover over the inside of the panels, to more nearly ensure that the polyurethane foam 30 (which is exposed after the protective film 12 has been peeled away) is less vulnerable to any interior fire. Traditional gypsum board having a thickness of ½ inch is the preferred interior cover for the wall panels, because of its insulating qualities and its ability to be cosmetically finished in a variety of pleasing ways.

The exterior of the wall panels 50 may be attractively finished with a stucco medium; or, one of the very thin decorative brick materials may be employed to give the building the appearance of a brick veneer house without the expense or structural deficiencies of such a construction. Other ways of decorating the exterior of the panels may, of course, be readily apparent to those skilled in the art, so that the resultant building may take on essentially any desired appearance. This is particularly appealing because the economies that accure to the builder from this construction technique are not in any way apparent in the external appearance of the completed building. In other words, while this invention may be produced more economically than many custom-made houses, it need not have the appearance of being built on a modest budget.

While a single-family residence made in accordance with this disclosure may look the same as many prior art houses, it will actually be much stronger than conventional wood-frame houses. In fact, exterior walls made with panels created by solidly filling 2×6 inch framing boards with 3000 psi concrete will be expected to have a loading strength of 50 pounds per square foot, while many conventional houses are only rated at about 20 pounds per square foot. In addition to overall strength, a wall made in accordance with this invention using nominally sized 2×6 board as concrete form members will have an average insulating value of R-11.

DETAILED DESCRIPTION OF AN EMBODIMENT OF THE INVENTION FOR MULTI-STORED BUILDINGS

Figure 9:
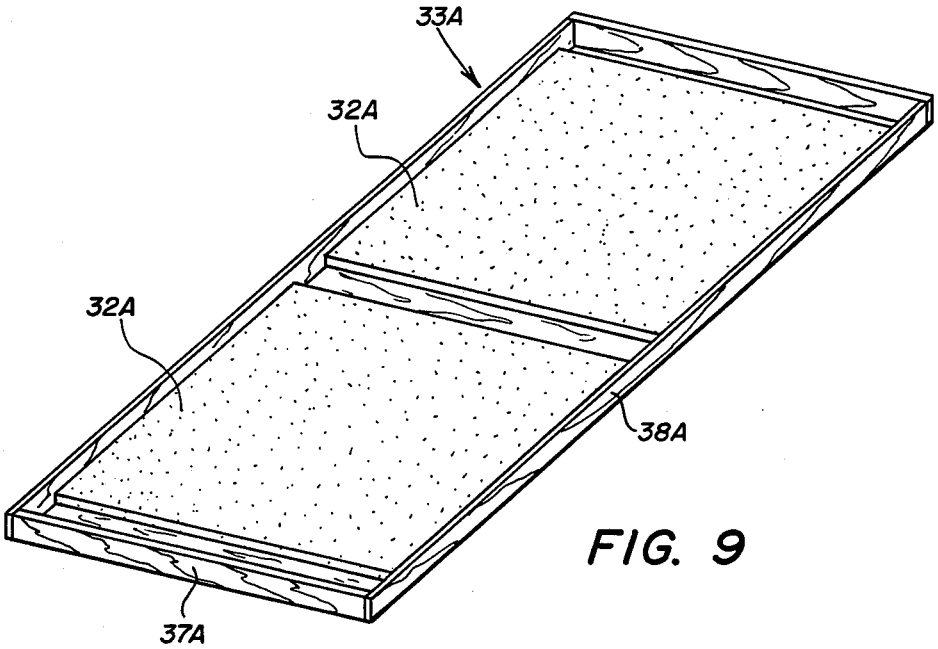
FIG. 9 is perspective view of a concrete form having two planar segments (or "plates") positioned therein, prior to the time that concrete is poured over the segments.
Figure 10:
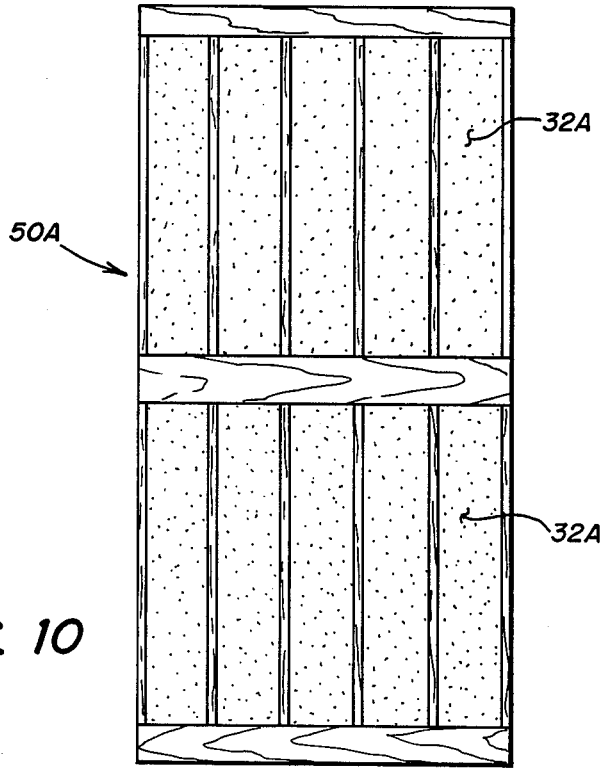
FIG. 10 is a perspective view of a multi-story panel in accordance with this invention, wherein two planar segments are exposed on the interior face of the panel at two different elevations.

The disclosure to this point has dealt primarily with concrete/foam panels intended for use in single-story buildings, but it would be entirely feasible to utilize the same principles in constructing multi-story buildings. For two-story or higher buildings, however, narrower panels would probably be employed--in order to limit their total weight and facilitate tilting them to an upright position. Referring next to FIG. 9, a planar segment 32A will be prepared for each floor of a multi-story building that is to have a cosmetically-finished interior. That is, if both the first and second floors of a two-story building are to have rooms which are finished out with gypsum board or the like, then two segments 32A will be pre-fabricated and brought to a construction site where a foundation has been prepared. The front surface of the respective planar segments will be oriented downward and the segments laid on top of the foundation. A separation distance will be established between the two segments, which distance is equal to the height of the anticipated structural support for the second floor. A concrete form of aluminum or wooden members will then be established around the planar segments, and concrete will then be poured into the form and on top of the segments. The concrete will be allowed to cure in direct contact with the rear surface of the planar segments 32A so as to form a composite concrete/foam panel. The peripheral frame members will, of course, be removed from the concrete/foam panels after the concrete has cured. Appropriate lifting cables will then be affixed to the "top" end of the panel, and probably at least one intermediate point thereof, and the panel will then be tilted upward so that it is essentially vertical (FIG. 10). As before, each tilted panel will be connected to the foundation and to such adjacent panels as are appropriate for completing the exterior part of the desired building. Floor joists would then be mechanically connected in a customary manner to the inside of the panel (between the two planar segments), and any desired cosmetic and/or protective covers would be fastened to the front surface of the respective segments.

To review the essential parts of the method disclosed herein, and to recite certain optional steps, a condensed listing of the important facets of the invention will now be presented, in an approximately sequential manner:

Prepare plans for the building and decide on the location of utilities for exterior walls.

Establish a generally horizontal and flat work surface.

Cover the work surface with a non-adherent film or separating agent.

Create on the work surface a peripheral frame for the first one of several panels.

Position wood-like interior members (e.g., wall studs) and secure them within the frame.

Position utility wires, conduits, boxes, pipes, etc., within the frame, usually adjacent the appropriate interior members.

If the finished panel is to have a window or door, position a suitable inner frame for said window or door inside the peripheral frame.

Generate an insulating foam inside the peripheral frame and on top of the film to a depth so as to cover the interior members and at least most of each of the peripheral frame members.

Allow the foam to cure so as to rigidly lock all elements in place within the peripheral frame, thereby creating a plate-like element that will become a layer or segment of the eventual panel.

If the foam is an open-cell plastic, seal the top of the foam so as to provide a water-proof surface for supporting wet concrete.

In a like manner, produce any additional plate-like segments that will be required for a given building.

Transport the finished segments to the building site where a foundation has been prepared.

Place each panel segment on a generally horizontal surface with its "interior side" down.

Place concrete form members around the plate-like segments.

Drive a few "anchor" nails through the foam and into the back side of some of the wood-like interior members.

Drive any additional "anchor" nails into certain frame members, as deemed desirable, if those frame members are to remain as a permanent part of the panel and if enhanced locking between the frame members and the concrete is desired.

Position any desired wire mesh or steel reinforcing members within the concrete form and suspend the same above the foam.

If desired, provide a loop of steel cable or a similar lifting element which will become anchored in the cured concrete.

Pour wet concrete into each of the peripheral forms and on top of the rigid foam, to a depth in excess of one inch but preferably to the top of the form, e.g., to a concrete depth of about four inches.

Allow the concrete to cure--to produce a plurality of load-bearing concrete/foam composite panels.

Remove any unwanted form members--such as the side and bottom members.

Tilt the cured panels upright and position them at appropriate locations on the foundation (usually near the edges of the foundation).

Peel any film away from the interior faces of the panels.

Connect the first panel to the foundation.

Connect adjacent panels to the foundation and to each other (as required).

Seal the joints between adjacent panels.

Cover the interior and exterior faces of the panels, as appropriate, with any cosmetic and/or protective materials (such as gypsum board)--to satisfy any local building codes or personal preferences.

While only the preferred techniques for practicing this invention have been disclosed in substantial detail herein, no doubt variations on the basic idea will be apparent to those skilled in the art of constructing tilt-wall buildings, etc. For example, the panels may be fabricated immediately next to the building's foundation instead of at a remote location like a factory or large shop. The stud-like vertical members may also be placed on 16-inch centers ratehr than 24-inch centers, but such a narrow spacing will simply mean that more of them will be used without any substantial increase in the load-bearing strength of the walls. The selected spacing between the stud-like members will most advantageously be based upon a number that is divisible into 48, so that 48-inch sheets of gypsum board can be readily nailed to those members. And concrete form members larger than nominally sized 2×6 inch boards may also be used, if more strength (from extra concrete) or more insulation (from more foamed plastic) should seem to be desirable. But dimensions for the basic panels described herein have been calculated to provide an appropriate strength and insulation rating that will satisfy most lending institutions and regulatory agencies that are concerned with health, safety and the public welfare; so any decision to use larger material sizes should be recognized to be primarily for personal preference and not because of necessity, at least for basic structures. Any other variations that fall within the scope of the attached claims will therefore be deemed to have been intended to form a part of this invention.

What is claimed is:

1. A building panel having utililty in a technique for fabricating tilt-wall structures, said panel having an interior and an exterior face and an upper and lower edge, comprising:

(a) an exterior face of cementitious material having sufficient thickness to function as a load-bearing member;

(b) a plurality of wood-like members arranged at spaced locations along the interior face of the panel, said wood-like members having a side-to-side spacing which is similar to that which is appropriate for wall studs in traditional wood-frame buildings; and (c) an insulating core of closed-cell plastic foam which is foamed in place over the wood-like members to hold them rigidly in place, said plastic foam being generated while the wood-like members are oriented horizontally, and said exterior face of cementitious material being cast in direct contact with the plastic form core so as to be integrally formed therewith.

2. The building panel as claimed in claim 1 wherein the foamed plastic is polyurethane having a density within the range of about 1½ to 4 pounds per cubic foot.

3. The building panel as claimed in claim 1 and further including at least one peripheral member of wood that is integrally connected to the cementitious face of the panel.

4. The building panel as claimed in claim 1 and further including a wooden frame member at the upper edge of the panel that is nailed to each of the plurality of wood-like members and which is connected to the cementitious face of the panel.

5. The building panel is claimed in claim 1 and further including a desired number of utility cables and service pipes which are permanently captured between the interior and exterior faces of the panel by virtue of positioning those utility cables and service pipes within a form before the cementitious material is cast therein, and said utility cables adn service pipes being initially held in their intended places by the foamed plastic before the cementitious material is added, whereby visual confirmation of the proper placement of utility cables and service pipes is readily effected at the time the foam plastic is generated.

6. The building panel as claimed in claim 1 wherein the panel is almost six inches thick and the cementitious face is about three inches thick in its thinnest region, and wherein the cementitious face averages about 4 inches in thickness.

7. The building panel as claimed in claim 1 wherein at least most of the wood-like members are formed from wooden boards having a nominal size of 2×2 inches.

8. The building panel as claimed in claim 1 wherein the panel has a thickness of slightly less than six inches but has an insulation rating of about R-11.

9. A building panel having utility in a technique for fabricating tilt-wall structures that have an interior and an exterior, said building panel having a major surface that serves as an interior face when the panel is oriented vertically, and the panel having an upper and lower edge when the panel is oriented vertically, comprising:

(a) an exterior face of cementitious material having a thickness of at least 3 inches and having adequate strength so that it may function as a load-bearing wall member in a tilt-wall structure, said cementitious material being cast in a generally horizontal orientation and being subsequently tilted upward after is has hardened;

(b) a plurality of wooden members arranged serially and generally vertically across the interior face of the panel, said wooden members comprising interior and outermost wooden members, with the two outermost wooden members being boards having a relatively large transverse cross-section, and the interior wooden members being boards having a relatively small transverse cross-section, and said large boards also serving as two edge boundaries for the panel;

(c) an insulating core of closed-cell plastic foam generated on top of and alongside the wooden members while they are oriented horizontally, said plastic foam thereby being integrally bonded to the wooden members so as to hold them rigidly in place, and the cementitious material being cast on top of the plastic foam after it hardens, such that the plastic foam is bonded between the cementitious face and the wooden members, said plastic foam core having a minimum thickness of ½ inch, whereby the interior wooden members are isolated from the exterior cementitious material by a minimum of ½ inch of isulating foam; and (d) a top member permanently anchored to the upper edge of the panel and having a size and orientation so as to facilitate the connection of a roof structure of said top member.

10. The building panel as claimed in claim 9 wherein the insulating foam material constitutes a rigid polyurethane foam having a density within the range of about 1½ to 4 pounds per cubic foot.

11. The building panel as claimed in claim 9 wherein the two large boards that serve as the edge boundaries of the panel having a nominal size of 2×4 inches, and the small boards that are laid interiorly of the panel have a nominal size of 2×2 inches.

12. The building panel as claimed in claim 9 and further including a foot member secured to the bottom of the plurality of wooden members and extending across the interior face of the panel near the lower edge of said panel.

13. The building panel as claimed in claim 9, wherein each of the two large boards has a rectangular transverse cross-section such that two of its sides are longer than its other two sides, and wherein said large boards are oriented and positioned so that one of their longer sides constitute a segment of the interior face of the panel.

14. The building panel as claimed in claim 9 and further including a plurality of locking members which mechanically anchor the exterior cementitious face to the interor wooden members, and said locking members being fastened to the wooden members snad being interally captured within the cementitious face by virtue of casting cementitious material around the locking members which protrude upwardly from the wooden members while the wooden members are horizontally oriented.

* * * * *